US007810774B2

(12) United States Patent
Miyaue

(10) Patent No.: US 7,810,774 B2
(45) Date of Patent: Oct. 12, 2010

(54) GOODS DISPLAY HOOK

(75) Inventor: Susumu Miyaue, Kanagawa (JP)

(73) Assignee: Shinden Co., Ltd., Kanagawa (JP)

( * ) Notice: Subject to any disclaimer, the term of this patent is extended or adjusted under 35 U.S.C. 154(b) by 352 days.

(21) Appl. No.: 12/047,652

(22) Filed: Mar. 13, 2008

(65) Prior Publication Data

US 2009/0230272 A1 Sep. 17, 2009

(51) Int. Cl.
*E04G 3/00* (2006.01)

(52) U.S. Cl. ..... 248/294.1; 248/550; 248/304; 362/132; 211/59.1; 211/57.1

(58) Field of Classification Search ..... 248/550, 248/211, 213, 215, 292.13, 294.1, 301, 304, 248/322, 339, 340; 211/57.1, 59.1, 7; 362/132, 362/190, 276, 396
See application file for complete search history.

(56) References Cited

U.S. PATENT DOCUMENTS

| | | | | | |
|---|---|---|---|---|---|
| 884,361 | A * | 4/1908 | Broga | 248/215 |
| 918,088 | A * | 4/1909 | Poppertt | 340/568.8 |
| 1,128,614 | A * | 2/1915 | Landemare et al. | 248/294.1 |
| 1,198,008 | A * | 9/1916 | Clive | 248/294.1 |
| 2,516,617 | A * | 7/1950 | Coughlin | 224/557 |
| 2,534,067 | A * | 12/1950 | Rubin | 473/487 |
| 2,895,702 | A * | 7/1959 | Pierce | 248/285.1 |
| 2,954,954 | A * | 10/1960 | Larson | 248/215 |
| 3,476,344 | A * | 11/1969 | Pace | 248/216.1 |
| 3,941,250 | A * | 3/1976 | Ott | 211/1.3 |
| 4,008,871 | A * | 2/1977 | Rex | 248/205.3 |
| 4,146,204 | A * | 3/1979 | Thalenfeld | 248/220.41 |
| 5,065,290 | A * | 11/1991 | Makar et al. | 362/132 |
| 5,594,419 | A * | 1/1997 | Lo | 340/568.1 |
| 6,029,827 | A * | 2/2000 | Valiulis | 211/59.1 |
| 6,378,828 | B1 * | 4/2002 | Valiulis et al. | 248/231.81 |
| 7,637,466 | B2 * | 12/2009 | Dillard | 248/280.11 |
| 2006/0113261 | A1 * | 6/2006 | Recknagel et al. | 211/59.1 |
| 2007/0102378 | A1 * | 5/2007 | Innis | 211/59.1 |

FOREIGN PATENT DOCUMENTS

| | | |
|---|---|---|
| JP | 2002-078578 | 3/2002 |
| JP | 2004-236975 | 8/2004 |

* cited by examiner

*Primary Examiner*—J. Allen Shriver, II
*Assistant Examiner*—Michael McDuffie
(74) *Attorney, Agent, or Firm*—Weiner & Burt, P.C.; Irving M. Weiner; Pamela S. Burt

(57) ABSTRACT

A goods display hook which enables salespersons to quickly and easily get information on the empty state of the goods display hooks. In a goods display hook comprising a main body engageable with a horizontally extending bar assembled in a goods display furniture and an arm including a base end supported by the main body and a goods hanging section extending from the base end section, the goods display hook further comprises a bias means for urging the arm in the direction that the goods hanging section tilts upwardly, the goods hanging section of the arm having a lamp at a free end thereof, the main body having a power source for the lamp, a switch device for the lamp and a shaft providing the arm with a pivotal movement, wherein the switch device is actuated by the arm to turn on the lamp when all the goods hung on the arm are removed which causes a pivotal movement of the arm in the direction that the goods hanging section tilts upwardly by the action of the bias means.

20 Claims, 5 Drawing Sheets

GOODS DISPLAY HOOK

FIELD OF THE INVENTION

The present invention relates to a hook for displaying goods that comprises a main body attachable to a horizontal rod and the like, such as a cross-rail, bar or horizontal frame of a display furniture placed in a store or shop for displaying goods, the hook having an arm including a base end section connected to the main body and a goods hanging section extending from the base end.

DESCRIPTION OF THE RELATED ART

Display furniture is in widespread use these days in stores such as supermarkets and convenience stores that do not need face-to-face selling activities. Typical types of display furniture may be designed to have cross-rails, bars or a grid wires assembled to a rectangular outer frame formed in a vertical plane.

A hook for displaying goods comprises a main body made of metal or synthetic resin and a goods hanging arm (hereinafter referred to as "arm"). The main body is formed so as to be engageable with a horizontally extending rod such as a cross-rail, bar or horizontal wire. The arm is designed so that its base end section is connected to the main body, and its goods hanging section is formed to extend perpendicularly to the vertical plane of the display furniture, so that various kinds of goods can be hung on the arm for display.

Conventional goods display hooks include those proposed in Patent documents 1 and 2, stated below. Goods are contained in a package having a hole or hook section for being hung. Shoppers draw out or remove the package containing goods from the arm of the goods display hooks to buy or for picking up to check it.

[Patent document 1] Japanese Patent Application Publication No. 2004-236975

[Patent document 2] Japanese Patent Application Publication No. 2002-78578

When all the goods hung on an arm have been removed, the goods assigned to that arm are replenished. It is advantageous for sales promotion to enable prompt replenishment as soon as all the goods on a display hook have been sold out. For that purpose, at present, it is necessary for salespersons to always look about the display furniture for the goods that have been sold out from the arm of the goods display hook. This may sometimes help in finding a so-called "hot-selling product".

SUMMARY OF THE INVENTION

Problems for the Invention to Solve

Generally, the stores have such a tendency to closely arrange a lot of display hooks on the cross-rails or bars of a display furniture on purpose to display as many goods as possible to improve sales efficiency. This makes it rather difficult for salespersons to locate the empty arms of display hooks when they are looking round display furniture under the care of them for replenishment.

The present invention has been made considering this problem to help salespersons to make easier locating and identifying empty arms among many display hooks closely arranged on the display furniture. It is therefore an object of the present invention to provide a display hook enabling salespersons to quickly and easily get information on the empty arms of the display hooks on the display furniture.

To solve the above-mentioned problem, the present invention provides a goods display hook comprising a main body engageable with a horizontally extending bar assembled in display furniture; an arm including a base end section pivotally connected to the main body and a goods hanging section extending from the base end section; and a bias means for urging the arm in the direction that the goods hanging section tilts upwardly, the goods hanging section of the arm having a lamp at the tip end thereof, the main body having a power source for the lamp, a switch device for the lamp and a shaft providing the arm with pivotal movement, wherein the switch device of the lamp is actuated by the arm to turn on the lamp when all the goods hung on the goods hanging section of the arm are removed and thus the arm is pivotally moved in the direction that the goods hanging section tilts upwardly by the action of the bias means.

The bias means is a spring element or a weight.

The switch device has a button retractably projecting from a housing of the switch device, the button being disposed in a range of the pivotal movement of the arm so that the switch is turned on, when the switch button is pressed by an acting portion of the base end section of the arm, or released from the pressure by the arm.

The switch device is a micro switch comprising a main unit housed in a switch housing and operating elements including a button and a lever provided on the housing, the lever having one end connected to the housing and the other end contacting the base end section of the arm, wherein the micro switch is designed to turn on the lamp either when the other end of the lever is pressed by the base end section of the arm to push the button or when the other end of the lever is released thereby releasing the button.

The main body of the display hook has a bar holding section designed for engaging with the cross-rail or bar assembled in the display furniture and an arm supporting section, the holding section having front and rear hanging walls to define a space for holding the cross-rail or bar of the display furniture between the walls, the arm supporting section having upright side walls for supporting the shaft therebetween about which the base end section of the arm being pivotally moved.

The holding section of the main body of the display hook supports the power source and a switch for the power source.

For the lamp, an LED lamp is used.

Technical Advantages of the Invention

In the display hook according to the present invention, when goods are hanging on the goods hanging section, the arm is prevented from moving up at the goods hanging section due to the load of the goods, and when all the goods hung on the arm are removed, the arm is pivotally moved by the action of the bias means such that the goods hanging section tilts upwardly and the base end section acts on the operating elements of the switch device to turn on the lamp. The lamp turned on makes it quicker and easier for salespersons to find an empty goods display hook.

The arm according to the present invention can pivotally move in the upward direction at a goods hanging section as soon as all the goods hung on the are removed due to the resilience of the spring element or the load of the weight.

The operating elements of the switch device are designed and disposed such that the pivotal movement of the arm in the upward direction at the goods hanging section can ensure the lighting of the lamp at the tip end of the goods hanging section of the arm.

The adoption of the micro switch ensures operation of the switch device, as well as downsizing of the main body of the goods display hook.

The main body of the goods display hook is designed to have a simple structure so as to be produced by an integral molding at low cost.

The power source for the lamp and the switch for the power source are attached to the holding section of the main body to ensure the stable engagement with the cross-rail or bar of the goods display furniture by the weight of the power source and power switch. The power switch can achieve saving of the power source.

An LED used for the lamp ensures a long service life of the lamp.

DESCRIPTION OF THE PREFERRED EMBODIMENT

Figure 1:
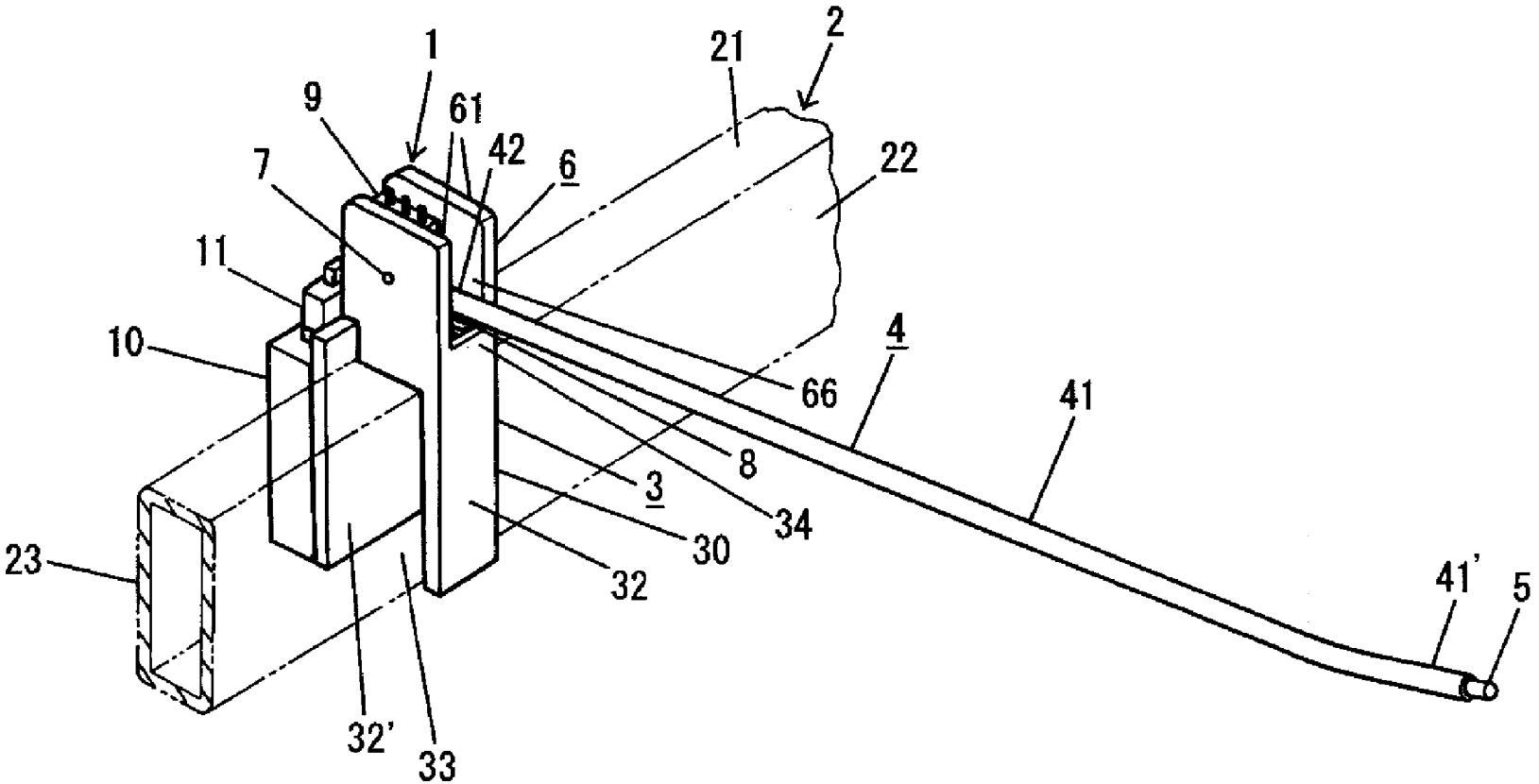
FIG. 1 is a perspective view of a first embodiment of a goods display hook according to the present invention.

A first embodiment of a goods display hook according to the present invention is described below referring to FIGS. 1-5 of the accompanying drawings.

A goods display hook 1 shown in FIG. 1 comprises a main body 3 and a goods hanging arm (hereinafter referred to as "arm") 4. The arm 4 has a goods hanging section 41, a free end 41' of which is slightly bent upward to prevent goods from dropping off and has an LED lamp 5 at a tip thereof.

Figure 3:
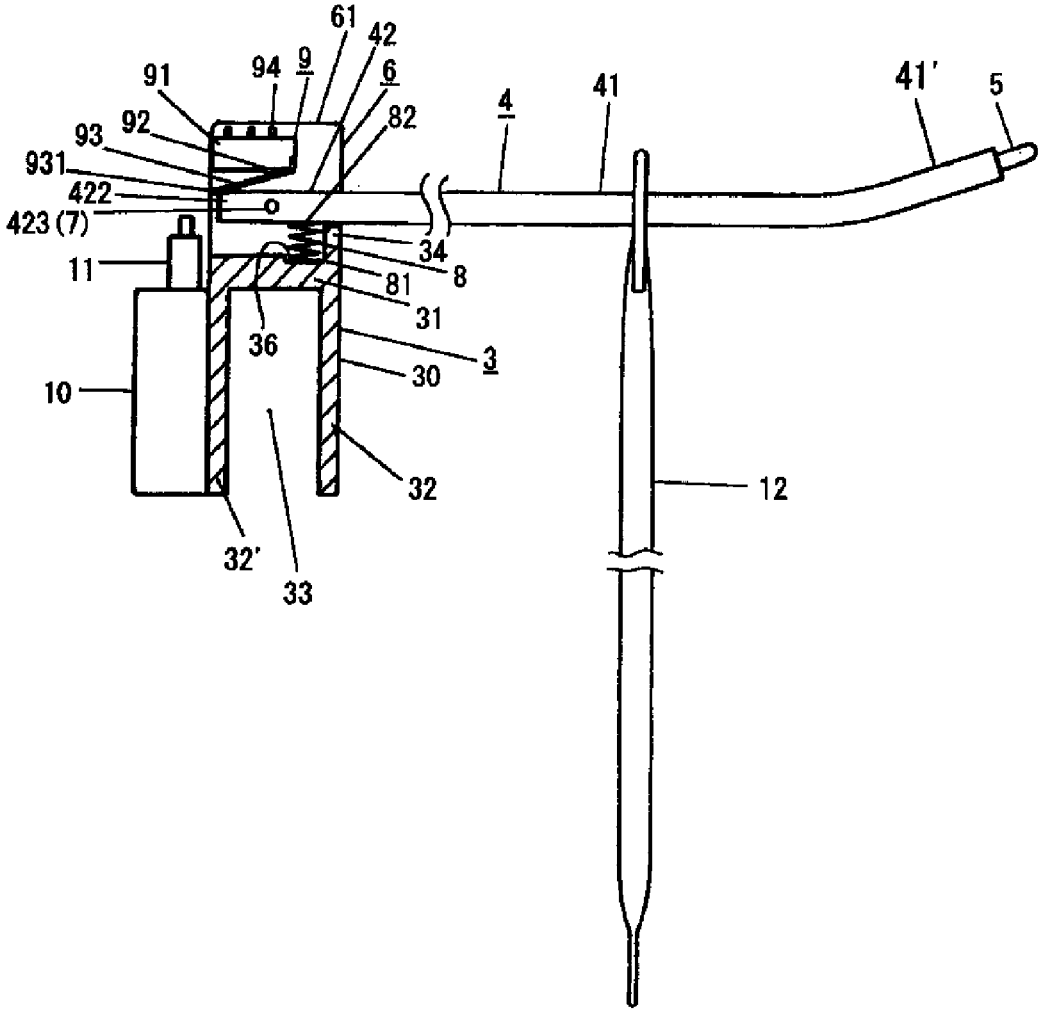
FIG. 3 is a cross-section view along the line A-A in FIG. 2 and shows the state where goods are hung in the embodiment shown in FIG. 1.

The main body 3 is adapted to engage with a crossrail 2 drawn by a double-dotted imaginary line in the formed of a rectangular pipe which is assembled in a goods display furniture (not shown). As shown in FIG. 3, the main body 3 includes a bar holding section 30 which is comprised of a base plate 31 positioned on the top surface 21 of the crossrail 2 and front and rear hanging walls 32 and 32' extending downwardly along the front and rear surface 22, 23 of the crossrail 2 from the front and rear end of the base plate 31. The crossrail 2 is held in a space 33 defined by the base plate 31, front and real hanging walls 32, 32' of the bar holding section 30 of the main body 3.

As shown in FIG. 3, an arm supporting section 6 is formed above the bar holding section 30 of the main body 3. The arm supporting section 6 comprises a pair of upright side walls 61, 61 which are upwardly extending from the top surface of the base plate 31 of the bar holding section 30 to define a space 66 being open toward the top, front and back. A shaft 7 is connected between the upright walls 61, 61. A base end section 42 of the arm 4 is housed in the open space 66 and pivotally connected to the side walls 61, 61 through the shaft 7 (See FIG. 1).

The arm supporting section 6 further has an upright front short wall 34 serving as a stopper against the downward pivotal movement of the arm about the shaft 7. When goods are hung on the goods hanging section 41 of the arm 4, the arm 4 is held substantially in a horizontal position while resting on the upper end of the short wail 34, and prevented from tilting down.

A recess 36 is formed on the surface of the base plate 31 adjacent to the short wall 34. The recess 36 and the short wall 34 define the housing of a coil spring 8. The coil spring 8 is provided beneath the arm 4 at a position between a portion pivotally connected by the shaft 7 to the arm supporting section 6 of the main body 3 and the goods hanging section 41 of the arm 4 for urging to the arm 4 such that the goods hanging section 41 pivotally moves upwardly about the shaft 7. Other types of spring elements such as a flat spring may be used instead of the coil spring 8.

Figure 2:
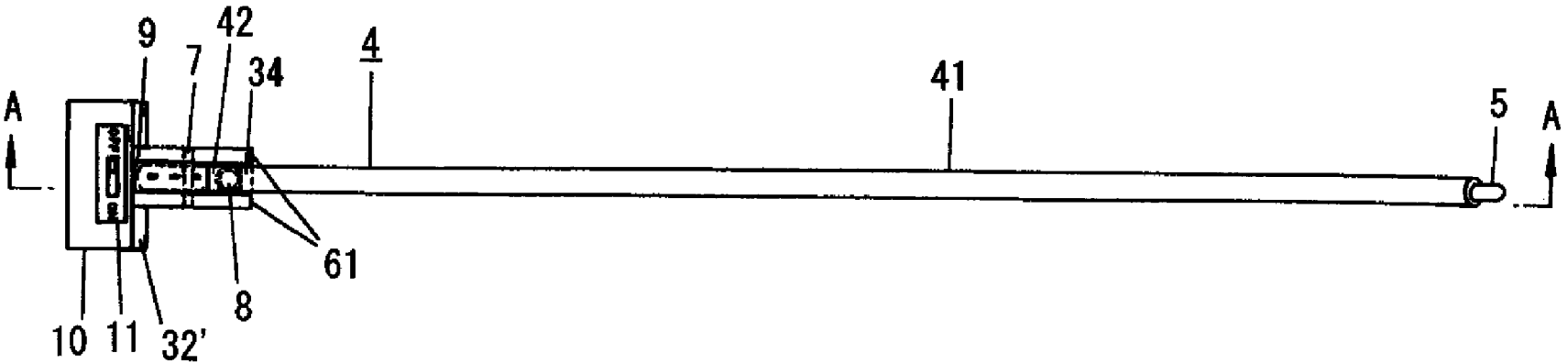
FIG. 2 is a plan view of the embodiment shown in FIG. 1.

As shown in FIGS. 1 to 3, a micro switch 9 is fixed to one of the side walls 61 at a position above the base end section 42 of the arm 4. A switch button 92 projects the underside of a housing 91 of the micro switch 9. A switch lever 93 having one end connected to the underside of the housing 91 and the other end 931 freely extending toward and coming into contact with the upper surface of an end 422 of the base end section 42 of the arm 4 which is on the opposite side of the shaft 7 to the goods hanging section 41. The micro switch 9 is provided on the top surface of the housing 91 with electric terminals 94 which are connected through lead lines not shown to a terminal of the LED lamp 5 attached to the free end 41' of the goods hanging section 41 of the arm 4 and to a terminal of a battery 10' described later (See FIG. 5).

The embodiment described has the micro switch 9 disposed above the arm 4 on one side of the shaft 7 and the coil spring 8 disposed below the arm 4 on the other side of the shaft. The mounting layout of these elements will however not be restricted to this arrangement. The positions of the micro switch 9 and the coil spring 8 may be reversed with respect to the arm 4 and/or shaft 7, or both the micro switch 9 and the coil spring 8 may be arranged on the same side with respect to the arm 4 and/or shaft 7.

The main body 3 is provided on the outer surface of the rear hanging wall 32' with a power source box 10 containing a battery 10'. The power source box 10 has a terminal of the battery 10' (not shown) on the upper surface thereof. A power switch 11 is disposed on the top surface of the power source box 10 and has a terminal (not shown) at the underside of its housing for electrical connection with the terminal of the battery 10' and the terminal 94 of the micro switch 9.

In this embodiment, the main body 3 has the bar holding section 30 engageable with the crossrail 2 of the goods display hook and the upright side walls 61, 61 constituting the arm supporting section 6 is made of synthetic resin and formed integrally with the bar holding section 30 of the main body 3. However, the bar holding section 30 may be designed to be engageable with a horizontally extending material in the form of a bar, rod or wire other than the crossrail. Likely, the arm supporting section 6 may be made of metal and may be formed separately from the bar holding section 30 of the main body 3.

Further, in the embodiment described above, an LED lamp is used for excellence in illuminance, a little power consumption, long service life as a light source, but other type of lamp including fluorescent lamp may be used. Lamps with different colors including red, blue, yellow and green may be used for the goods display hooks according to the present invention to classify the goods to be hung on the hook by the different colors. This would help salespersons to find sold-out goods easily by glancing at the color of the lamp associated with the sold-out goods.

Then, a typical example of operation of the first embodiment according to the present invention will be explained referring to FIGS. 3, 4 and 5.

In the state as shown in FIG. 3 where goods 12 are hung on the arm 4, the goods hanging section 41 of the arm 4 keeps a horizontal position while resting on the top surface of the short upright wall 34 serving as a stopper against the load of the goods 12 overcoming the resilient force of the coil spring 8. In this state, the end 422 of the base end section 42 of the arm 4 contacts and presses the free end 931 of the switch lever 93 upward which in turn presses the switch button 92 at the intermediate portion of the lever.

As apparent from the above, the button 92 and the lever 93 constitute an operating means of the micro switch 9 while the end 422 of the base end section 42 serves as an actuating means acting on the operating means of the micro switch 9.

Figure 5:
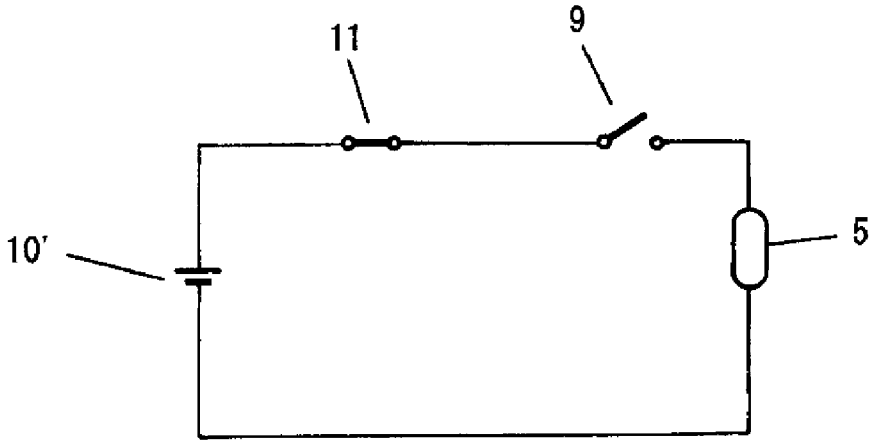
FIG. 5 is an electric circuit diagram of the embodiment shown in FIG. 1.

FIG. 5 shows an electric circuit of the goods display hook 1 in the state as shown in FIG. 3 where goods 12 are hung on the goods hanging portion 41 of the arm 4 and the switch button 92 is pressed. In this state, as apparent from FIG. 5, the micro switch 9 is kept off. Accordingly, as long as goods 12 are hung on the goods hanging section 41 and the switch button 92 is pressed, the micro switch 9 is not actuated even though the power source switch 11 is on, to thereby prevent the voltage of the battery 10' from being applied to the LED lamp 5 which is kept turned off. By changing the positional relationship between the micro switch 9 and the arm 4, the electric circuit may be configured such that the micro switch 9 is actuated when the arm 4 is released from a load of goods hung thereon.

Figure 4:
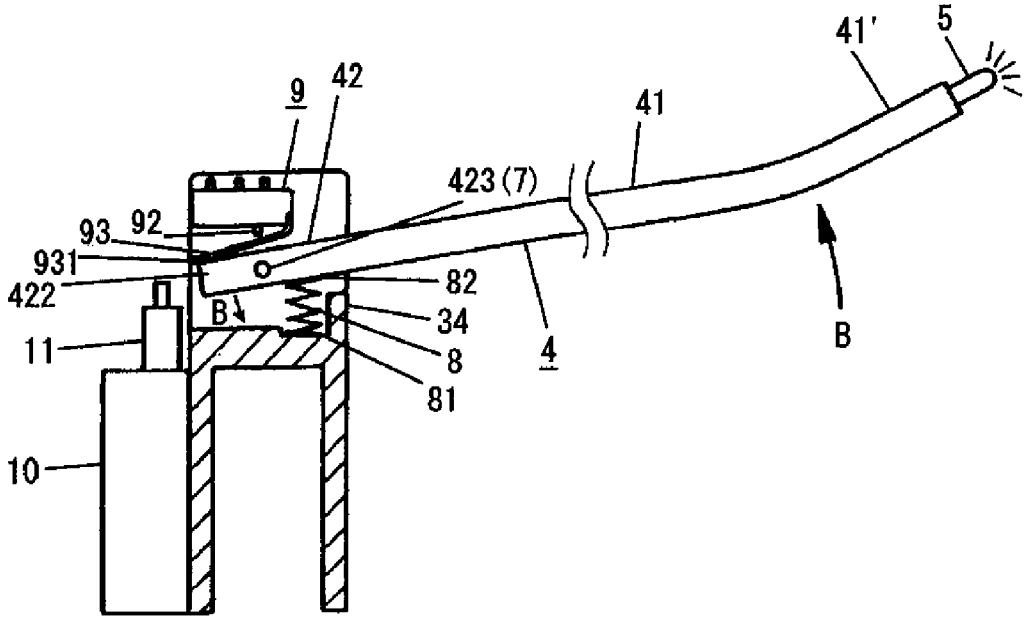
FIG. 4 is a cross-section view along the line A-A in FIG. 2 and shows the state where goods are all removed in the embodiment shown in FIG. 1.

FIG. 4 shows the goods display hook 1 in the state where goods 12 are all removed from the goods hanging section 41 and there is no load on the arm 4. The coil spring 8 pushes up the portion of the arm 4 between the pivoted portion 423 by the shaft 7 and the goods hanging section 41, thereby pivotally moving the goods hanging section 41 of the arm 4 upward, in the counterclockwise direction B in the figure. At this time, since the opposite end 422 of the arm 4 is moved downward to release the force applied to the free end 931 of the lever 93 which in turn releases the pressure on the switch button 92.

In the state as shown in FIG. 4, the electric circuit is configured so as to turn on the micro switch 9. If the power switch 11 is on, the voltage of the battery 10' is applied to the LED lamp 5 to turn on the lamp.

Since the lit LED lamp 5 associated with the goods display hook having no goods hung on the arm can be easily found among many goods display hooks arranged on the display furniture, it is possible to replenish the hook with goods as soon as and just after the goods have been sold-out. The LED lamp 5 can be set to remain lit unless the hook is replenish with goods for smooth replenishment. In the case where there is no stock for missing goods, the power source switch can be switched off to prevent power distribution to the LED lamp 5 until replenishment with goods becomes possible. When the goods are delivered, switching on the power supply switch 11 and hanging the goods on the arm 4 presses the switch button 92 to prevent power distribution to the LED lamp 5, thereby turning off the LED lamp 5.

Figure 6:
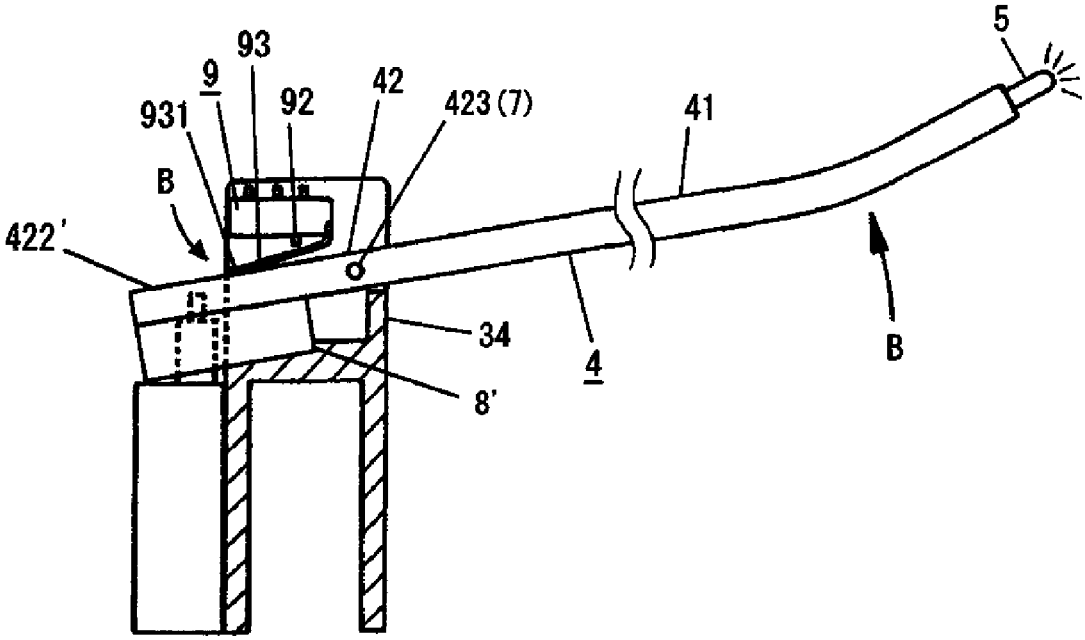
FIG. 6 is a cross-section view of a second embodiment of the present invention and shows the state where goods are all removed.

A second embodiment of a goods display hook according to the present invention is described, referring to FIG. 6, in which a weight is used instead of the spring element 8 of the first embodiment. FIG. 6 shows a cross-section view in the state where the hook is empty.

In the second embodiment, a weight 8' is attached to the lower surface of the base end section 42 of the arm 4 including an end 422'. The weight 8' is formed separately from the base end section 42 of the embodiment, but it may be formed integrally with the arm, and may be made of metal or synthetic resin.

An operation of the second embodiment of a goods display hook according to the present invention is described herein after almost the same as the first embodiment.

Namely, as shown in FIG. 6, there is no load of the goods 12 applied to the goods hanging section 41 of the arm 4. The end 422' of the base end section 42 of the arm 4 tilts down by the load of the weight 8'. This movement of the arm 4 releases the force applied to the free end 931 of the switch lever 93 which in turn releases the pressure applied to the switch button 92, thereby actuating the micro switch 9 to turn on the LED lamp 5.

The operation of the second embodiment in the state where goods 12 are hung on the hanging section 41 of the arm 4 is the same as that of the first embodiment and therefore omitted.

The invention claimed is:

1. A goods display hook comprising:

a main body engageable with a horizontally extending bar assembled in a goods display furniture; and an arm including a base end section pivotally connected to said main body and a goods hanging section extending from said base end section;

and a bias means for urging said arm in the direction that said goods hanging section tilts upwardly, said goods hanging section of said arm having a lamp at a free end thereof, said main body having a power source for said lamp, a switch device for said lamp and a shaft providing said arm with pivotal movement, wherein said switch device is actuated by said arm to turn on said lamp when all the goods hung on said hanging section are removed which causes pivotal movement of said arm in the direction that said goods hanging section tilts upwardly by the action of said bias means.

2. A goods display hook according to claim 1, wherein said bias means is a spring element or a weight.

3. A goods display hook according to claim 1, wherein said bias means is a weight.

4. A goods display hook according to claim 1, wherein said switch device has means for operating the switch device retractably projecting from a housing of the switch device, and the switch operating means being disposed in a range of the pivotal movement of the arm so that the switch is turned on when the switch operating means is acted by an actuating portion of the arm.

5. A goods display hook according to claim 1, wherein said switch device is a micro switch comprising a body section housed in a housing and said switch operating means including a button and a lever provided on said housing, said lever having one end connected to said housing and the other end contacting said base end section of said arm, wherein said micro switch is designed to turn on said lamp either when the other end of said lever is pressed by said base end section of said arm to push said button or when the other end of said lever is released thereby releasing said button.

6. A goods display hook according to claim 1, wherein said main body of the display hook has a bar holding section designed for engaging with a cross-rail or bar assembled in the display furniture and an arm supporting section, said bar holding section having front and rear hanging walls to define a space for holding said cross-rail or bar of the display furniture between said walls, said arm supporting section having upright side walls for supporting said shaft therebetween about which said base end section of the arm being pivotally moved.

7. A goods display hook according to claim 2, wherein said main body of the display hook has a bar holding section designed for engaging with a cross-rail or bar assembled in the display furniture and an arm supporting section, said bar holding section having front and rear hanging walls to define a space for holding said cross-rail or bar of the display furniture between said walls, said arm supporting section having upright side walls for supporting said shaft therebetween about which said base end section of the arm being pivotally moved.

8. A goods display hook according to claim 3, wherein said main body of the display hook has a bar holding section designed for engaging with a cross-rail or bar assembled in the display furniture and an arm supporting section, said bar holding section having front and rear hanging walls to define a space for holding said cross-rail or bar of the display furniture between said walls, said arm supporting section having upright side walls for supporting said shaft therebetween about which said base end section of the arm being pivotally moved.

9. A goods display hook according to claim 4, wherein said main body of the display hook has a bar holding section designed for engaging with a cross-rail or bar assembled in the display furniture and an arm supporting section, said bar holding section having front and rear hanging walls to define a space for holding said cross-rail or bar of the display furniture between said walls, said arm supporting section having upright side walls for supporting said shaft therebetween about which said base end section of the arm being pivotally moved.

10. A goods display hook according to claim 5, wherein said main body of the display hook has a bar holding section designed for engaging with a cross-rail or bar assembled in the display furniture and an arm supporting section, said bar holding section having front and rear hanging walls to define a space for holding said cross-rail or bar of the display furniture between said walls, said arm supporting section having upright side walls for supporting said shaft therebetween about which said base end section of the arm being pivotally moved.

11. A goods display hook according to claim 6, wherein said bar holding section of said main body of the display hook supports said power source and a switch for said power source.

12. A goods display hook according to claim 7, wherein said bar holding section of said main body of the display hook supports said power source and a switch for said power source.

13. A goods display hook according to claim 8, wherein said bar holding section of said main body of the display hook supports said power source and a switch for said power source.

14. A goods display hook according to claim 9, wherein said bar holding section of said main body of the display hook supports said power source and a switch for said power source.

15. A goods display hook according to claim 10, wherein said bar holding section of said main body of the display hook supports said power source and a switch for said power source.

16. A goods display hook according to claim 1, wherein said lamp is an LED lamp.

17. A goods display hook according to claim 2, wherein said lamp is an LED lamp.

18. A goods display hook according to claim 3, wherein said lamp is an LED lamp.

19. A goods display hook according to claim 4, wherein said lamp is an LED lamp.

20. A goods display hook according to claim 5, wherein said lamp is an LED lamp.

* * * * *